US007623805B2

(12) United States Patent
Noguchi

(10) Patent No.: US 7,623,805 B2
(45) Date of Patent: Nov. 24, 2009

(54) IMAGE HEATING APPARATUS AND IMAGE FORMING APPARATUS

(75) Inventor: Junichi Noguchi, Suzhou New District (CN)

(73) Assignee: Canon Kabushiki Kaisha, Tokyo (JP)

( * ) Notice: Subject to any disclaimer, the term of this patent is extended or adjusted under 35 U.S.C. 154(b) by 290 days.

(21) Appl. No.: 11/694,382

(22) Filed: Mar. 30, 2007

(65) Prior Publication Data

US 2007/0230984 A1 Oct. 4, 2007

(30) Foreign Application Priority Data

Mar. 31, 2006 (JP) ..... 2006-098917

(51) Int. Cl.
*G03G 15/20* (2006.01)

(52) U.S. Cl. ..... 399/70

(58) Field of Classification Search ..... 399/67, 399/69, 70, 329
See application file for complete search history.

(56) References Cited

U.S. PATENT DOCUMENTS 4,242,566 A * 12/1980 Scribner ..... 399/329 X
6,370,352 B1 * 4/2002 Tomita ..... 399/329 X
6,999,710 B2 * 2/2006 Kasahara ..... 399/329
7,324,773 B2 * 1/2008 Sugiyama ..... 399/67 X
7,406,288 B2 * 7/2008 Nakamoto et al. ..... 399/329
7,437,112 B2 10/2008 Yamaji
7,454,151 B2 * 11/2008 Satoh et al. ..... 399/69
2005/0271407 A1 * 12/2005 Fujimori ..... 399/70

FOREIGN PATENT DOCUMENTS

JP 1-144084 A 6/1989
JP 6-318001 A 11/1994
JP 10-312132 A 11/1998
JP 2001-100589 A 4/2001
JP 2005-121899 5/2005

* cited by examiner

*Primary Examiner*—Sandra L Brase
(74) *Attorney, Agent, or Firm*—Fitzpatrick, Cella, Harper & Scinto

(57) ABSTRACT

An image heating apparatus comprises an endless belt for heating an image on a recording material. A heating member is provided for heating a part of the endless belt and a contact member is provided for contacting an inner surface of the belt. A stand-by control unit is operable in a stop period in which the heating member effects heating with the belt at rest and in a rotation period in which the belt is rotated, and a drive stop control unit is provided for stopping the endless belt at a position that the contact member contacts at least a part of a portion of the endless belt that has been opposed to the heating member in a previous stop period.

9 Claims, 9 Drawing Sheets

IMAGE HEATING APPARATUS AND IMAGE FORMING APPARATUS

FIELD OF THE INVENTION AND RELATED ART

The present invention relates to a preferable image heating apparatus as a fixing apparatus mountable in an image forming apparatus, such as a copying machine, a printer, a facsimile machine, etc. More specifically, it relates to an image heating apparatus of the so-called belt type.

An image forming apparatus of the belt type has: an endless belt; a driving means for rotationally driving the endless belt; a heating means for applying heat to the portion of the endless belt, which is moving through the heating range of the heating means. It is an apparatus structured so that the image on recording medium can be heated by placing the recording medium in contact with the endless belt which is heated by the heating means while being rotationally driven by the driving means.

The endless belt is heated by the heating means, only across the area which is moving through the heating range of the heating means. However, since the endless belt is rotationally driven, the entirety of the endless belt is heated while the belt is rotationally driven. The endless belt is controlled in its temperature. More specifically, the amount by which electric power is supplied to the heating means is controlled by a temperature controlling portion, which includes a temperature detecting member, so that the temperature of the endless belt, which is detected by the temperature detecting member, remains at a preset level.

Japanese Laid-open Patent Application 6-318001 describes a fixing apparatus of the belt type. This fixing apparatus is provided with a heating passage through which a recording medium and a toner image thereon are conveyed to be preheated by a heating means through a fixation belt so that the temperature of the fixation nip can be set to a lower level.

Japanese Laid-open Patent Application 2001-100589 describes another fixing apparatus of the belt type. This fixing apparatus keeps on rotationally driving its fixation belt even after the heating of the fixation belt by the heating means is stopped. The rotation of the fixing belt is stopped after the temperature of the fixation belt, which is detected by the temperature detecting member, falls below a preset level. This setup is for preventing the problem that allowing the temperature of the fixation belt to become locally high drastically diminishes the fixation belt in durability.

Japanese Laid-open Patent Application 1-144084 describes another fixing apparatus of the belt type. This fixing apparatus is provided with a heating coil of the electromagnetic induction type, which is placed in the adjacencies of the outward surface of the fixation belt, in terms of the circular track which the fixing belt forms. The employment of the heating coil is intended to reduce the length of time necessary for warming up the fixation belt.

In the case of a fixing apparatus of the belt type, such as those described above, the endless belt must be continuously run (rotated) while the belt is adjusted in temperature. Without being continuously run, the portion of the endless belt, which is facing the heating means, becomes substantially higher in temperature than the rest of the endless belt, which drastically reduces the endless belt in durability.

On the other hand, as an endless belt increases in the cumulative length of running time, cracks develop in the surface layer of the endless belt. Thus, there is a limit to the total length of time the endless belt can be rotated (endless belt has limited life span).

As one of the countermeasures for the abovementioned problem, Japanese Laid-open Patent Application 10-312132 describes a fixing apparatus of the belt type, which is provided with a fixation roller and a pressure belt. The pressure belt is heated by the heat roller, across the area which is in contact with the heat roller. When this fixing apparatus is on standby, the pressure belt is continuously rotated or kept stationary according to the detected temperature of the pressure belt. Further, the speed at which the pressure belt is rotated while the fixing apparatus is kept on standby, is slower than that while an image is actually formed. This structural arrangement can reduce the amount of stress to which belt is subjected.

However, a fixing apparatus of the endless type, which employs a heating system which always (whether fixation belt is kept stationary or being rotated) heats its fixation belt only across the portion which faces its heating means, even while the fixing apparatus is on standby, suffers from the following problem. That is, if a portion of the fixation belt, which is heated while the fixation belt is kept stationary first time during a standby period, is positioned in the heating area when the fixation belt is kept stationary next time and thereafter, the amount of stress to which this portion of the fixation belt is subjected is very large. On the other hand, the components, such as an endless belt supporting member, which come into contact with the endless belt are greater in thermal capacity, being therefore slower to warm up, than the endless belt.

SUMMARY OF THE INVENTION

The primary object of the present invention is to provide an image heating apparatus, which does not allow heat to concentrate in certain portions of its endless belt when heating the endless belt in a standby period, and also, warms up in a preferable manner, its members which are in contact with the endless belt.

According go an aspect of the present invention, there is provided an image heating apparatus comprising an endless belt for heating an image on a recording material; heating means for heating a part of said endless belt; driving means for rotating said belt; a first contact member for contacting an inner surface of said belt; stand-by control means operable in a stop period in which said heating means effects heating with said belt at rest and in a rotation period in which said belt is rotated; and drive stop control means for stopping, upon stoppage of rotation of said in said rotation period, said endless belt at such a position that contact member contacts at least a part of such a portion of said endless belt as has been opposed to said heating means in a previous stop period.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

Embodiment 1

<Image Forming Portion>

Figure 1:
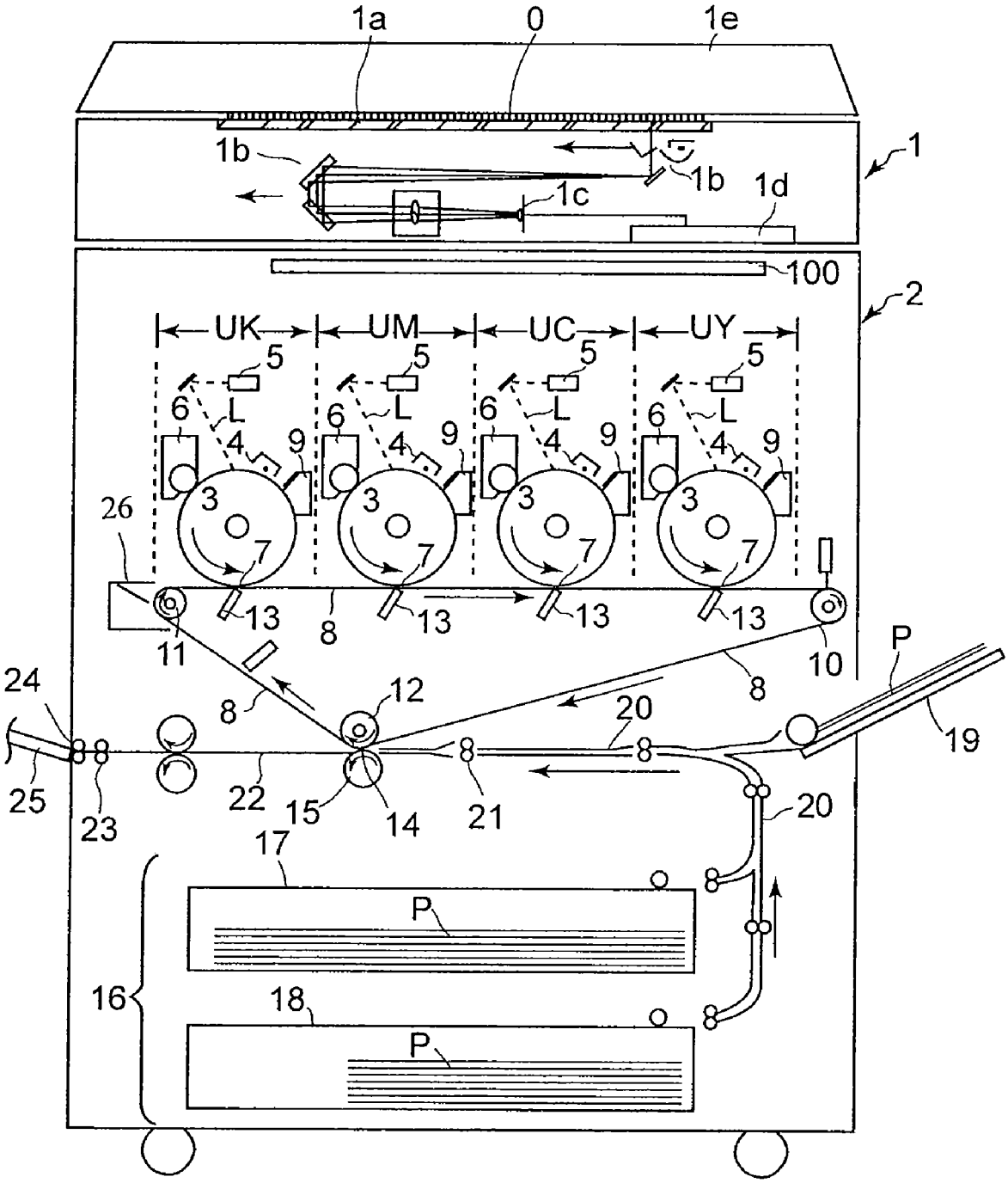
FIG. 1 is a schematic sectional view of the image forming apparatus in the first preferred embodiment of the present invention, showing the general structure thereof.

FIG. 1 is a sectional view of the image forming apparatus in this embodiment, and shows the general structure of the apparatus. This image forming apparatus is an electrophotographic multifunction full-color image forming apparatus which is capable of functioning as a printer, a copying machine, and a facsimile machine. First, the image forming portion of the apparatus will be described.

Designated by a referential number 1 is an image reading portion, which has: a glass platen 1*a* on which an original O (multicolor color image, for example) is to be placed; a movable optical system 1*b*; and a full-color sensor 1*c* (CCD) . The image reading portion 1 scans the original on the glass platen la, with the beam of light which the movable optical system 1*b* projects, and receives by the full-color sensor 1*c*, the light reflected by the surface of the original O. The full-color sensor 1*c* separates the reflected light it receives, into lights of the primary colors, and outputs signals (picture signals) which correspond to the lights of the primary colors. These signals are subjected to preset processes in the image processing portion 1*d*, and are sent to the control unit 100 (controlling means) of the image outputting portion 2. Designated by a referential character 1*e* is a plate for pressing an original, or an apparatus for automatically feeding an original (ADF, RDF).

The control unit 100 has a CPU, and plays the roles of driving the various internal portions of the image forming apparatus, collecting and analyzing the information sent from various sensors, and exchanging data with the control panel (user interface), etc. In other words, the entire operation of the image forming apparatus is controlled by this control unit 100.

The image outputting portion 2 has four image forming units UK, UM, UC, and UY, or the first, second, third, and fourth image forming units, respectively, which are juxtaposed in tandem in the top portion of the image outputting portion 2, being arranged left to right in the listed order. Each image forming unit is an electrophotographic image forming unit, which uses a beam of light to expose a photosensitive drum. The four image forming units are identical in structure. The image forming unit UK is an image forming unit for forming a toner image of black color; the image forming unit UM, a toner image of magenta color; the image forming unit UC, a toner image of cyan color; and the image forming unit UY is an image forming unit for forming a toner image of yellow color.

Designated by a referential number 3 in each of the image forming units UK, UM, UC, and UY, is an electrophotographic photosensitive member, as an image bearing member, which is in the form of a drum and is rotationally driven in the counterclockwise direction indicated by an arrow mark. Designated by a referential number 4 is a primary charging device for uniformly charging the peripheral surface of the drum 3, and designated by a referential number 5 is a laser-based exposing device which forms an electrostatic latent image which reflects the aforementioned picture signals, by scanning (exposing) the uniformly charged area of the peripheral surface of the drum 3 with the beam of laser light which it projects while modulating the light with the picture signals. Designated by a referential number 6 is a developing apparatus for developing the electrostatic latent image on the peripheral surface of the drum 3 into a visible image, that is, a toner image. The developing apparatus 6 of the first image forming unit UK contains black toner as developer, and the developing apparatus of the second image forming unit UM contains magenta toner as developer. The developing apparatus 6 of the third image forming unit UC contains cyan toner as developer, and the developing apparatus of the fourth image forming unit UY contains yellow toner as developer.

The first image forming unit UK is controlled so that a black toner image is formed on the peripheral surface of the drum 3, with a preset control timing, in response to the picture signals sent from the image processing portion 1*d* to the control unit 100. The second image forming unit UM is controlled so that a magenta toner image is formed on the peripheral surface of the drum 3, with a preset control timing, in response to the picture signals sent from the image processing portion 1*d* to the control unit 100. The third image forming unit UC is controlled so that a cyan toner image is formed on the peripheral surface of the drum 3, with a preset control timing, in response to the picture signals sent from the image processing portion 1*d* to the control unit 100. The fourth image forming unit UY is controlled so that a yellow toner image is formed on the peripheral surface of the drum 3, with a preset control timing, in response to the picture signals sent from the image processing portion 1*d* to the control unit 100.

The toner image formed in each of the image forming units is transferred onto an intermediary transfer belt 8 (which hereafter may be referred to simply as belt), which is endless and flexible, in the primary transfer portion 7 of each image forming unit, while the intermediary transfer belt 8 is rotationally driven. In other words, the four toner images, which are different in color, are sequentially transferred in layers onto the intermediary transfer belt 8, effecting thereby an unfixed full-color image on the intermediary transfer belt 8. The toner particles remaining on the drum 3 in each image forming unit after the toner image transfer, that is, the toner particles which failed to be transferred, are removed by a cleaning apparatus 9.

The belt 8 is stretched around a driver roller 10, a follower roller 11, and a belt backup roller 12, and is rotationally driven in the clockwise direction indicated by an arrow mark, at a speed which is roughly equal to the peripheral velocity of the drum 3. The belt 8 is positioned so that it is placed in contact, or virtually in contact with, the downwardly facing portion of the peripheral surface of the drum 3 of each image forming unit, by the portion between the driver roller 10 and follower roller 11, forming thereby the primary transferring portion 7 for each image forming portion. Designated by a referential number 13 is a primary charging device for image transfer, which is disposed on the inward side of the circular track which the belt 8 forms, at a point which corresponds to each image forming unit, and is placed in contact with the inward surface of the belt 8. To this charging device 13, a preset voltage is applied when transferring (primary transfer) a toner image onto the belt 8.

As the belt 8 is continuously rotated, the abovementioned unfixed full-color toner image on the surface of the belt 8 reaches the toner image transferring second portion 14 (which hereafter will be referred to as second transferring portion). The second transferring portion 14 is a nip made up of the aforementioned belt backup roller 12, a second transfer roller 15, and the portion of the belt 8, which the belt backup roller 12 and second transfer roller 15 pinch. A recording medium P, which is in the form of a sheet, is fed into the image forming apparatus from the automatic recording medium feeding unit 16, or manual recording medium feeding tray 19, and is delivered to this second transferring portion 14, with a preset control timing. Thus, the four color toner images on the intermediary transfer belt 8, which is effecting the unfixed full-color toner image on the intermediary transfer belt 8, are transferred together (secondary transfer) onto the recording medium P as if they were being peeled away from the intermediary transfer belt 8. To the second transfer roller 15, a preset voltage is applied during the second transfer of the toner images.

The paper feeding unit 16 has two paper feeding cassettes 17 and 18, that is, the top and bottom feeding cassettes, which are different in the size of the recording medium P which they store. As an image forming operation is started, the recording mediums P are fed one by one, with a preset control timing, into the main assembly of the image forming apparatus from the top or bottom paper feeding cassette which contains the recording mediums P which are correct in size for the image forming operation. After being fed into the image forming apparatus main assembly from the automatic paper feeding unit 16 or manual paper feeding tray 19, each recording medium P is conveyed through a sheet path 20 to a pair of registration rollers 21. At the moment of the arrival of the recording medium P at the registration roller 21, the registration rollers 21 are stationary. As the recording medium P reaches the pair of registration rollers 21, the leading edge of the recording medium P hits the nip which the two registration rollers 21 form. Then, the registration rollers 21 begin to be rotationally driven in synchronization with the starting of the image forming operation in each of the image forming units UK, UM, UC, and UY. The point in time at which the registration rollers 21 is to begin to be rotationally driven is set so that the leading edge of the recording medium P and the leading edge of the toner images on the belt 8 (toner images having been transferred in layers onto intermediary transfer belt 8 from image forming units) reach the second transferring portion 14 at the same time.

After the transfer of the toner images on the belt 8 onto the recording medium P in the second transferring portion 14, the recording medium P is separated from the belt 8, and is guided by a conveyance guide 22 into a fixing apparatus F, which is an image heating apparatus. The fixing apparatus F is a unit which is removably mountable in the image forming apparatus. The toner images on the recording medium P are thermally fixed to the surface of the recording medium P by the fixing apparatus F. After being moved out of the fixing apparatus F, the recording medium P is discharged by two pairs 23 and 24 of paper discharging rollers so that the recording medium P settles in layers in a delivery tray 25.

Designated by a referential number 26 is a cleaning unit for cleaning the surface of the belt 8. The toner particles remaining on the belt 8, that is, the toner particles which failed to be transferred onto the recording medium P in the second transferring portion 14, are removed by this unit 26.

When the image forming apparatus is in the monochromatic mode, the first image forming unit UK, which forms a black toner image, is activated to output monochromatic copies.

The above described image forming apparatus can be used as a copying machine by inputting the picture signals generated by photoelectrically reading an original by the image reading portion, into the control unit 100 of the image outputting unit 2. It also can be used as a printer by inputting the picture signals into the control unit 100 from an external host apparatus, such as a personal computer, or the like. Further, it can be used as the printing portion of a facsimile machine by inputting into the control unit 100, the picture signals sent from another facsimile machine, or the transmitting portion of a facsimile machine, which transmits the picture signals generated by photoelectrically reading an original by the image reading portion 1.

<Image Forming Process of Image Forming Apparatus>

Figure 2:
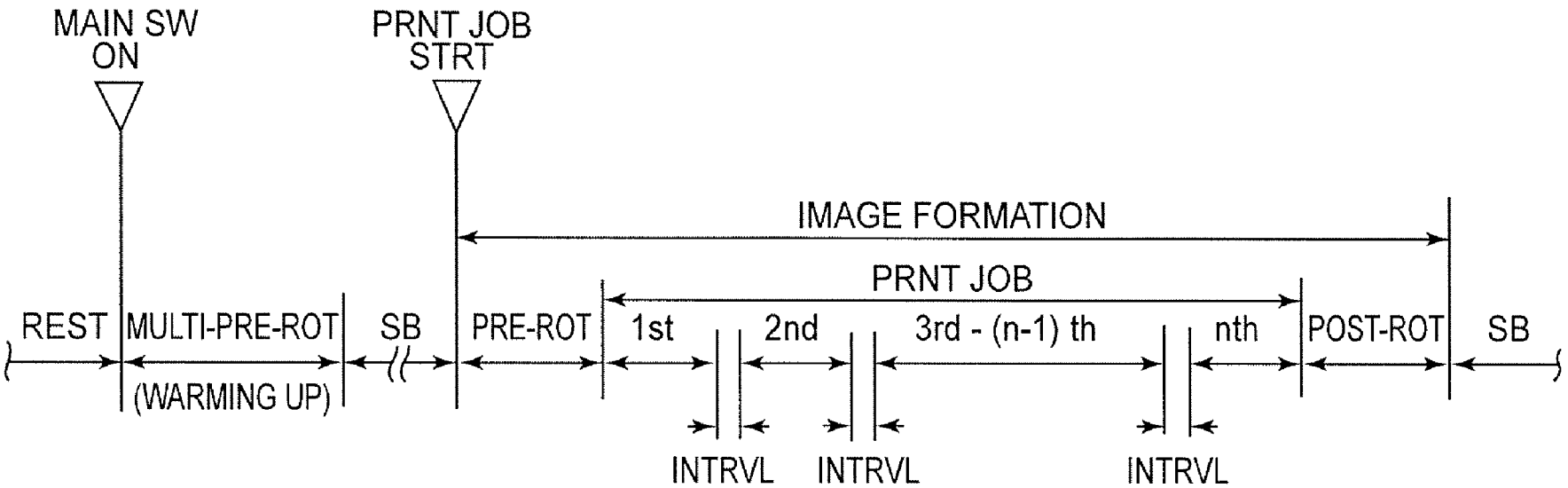
FIG. 2 is the operation diagram for the image forming apparatus.

FIG. 2 is an operational diagram of this image forming apparatus.

1) Nonoperational step: the switch of the main power source of the image forming apparatus is off.
2) Multiple pre-rotation step: the image forming apparatus is warmed up; the switch of the main power source is turned on to start the main motor, in order to start up the processing devices necessary for image formation.
3) Standby step: after the completion of the multiple pre-rotation step, the main motor is stopped, and the image forming apparatus is kept on standby for the inputting of a printing job start signal (image formation start signal).
4) Image forming step: this step includes the pre-rotation step, pre printing job step, and post-rotation step.

In the pre-rotation step in the image forming step, the main motor is restarted in response to the printing job start signal, and various pre-printing jobs are performed by the various processing devices necessary for the printing job. More specifically, a: the control unit 100 receives the printing job start signal; b: an image is developed by a formatter (length of time necessary for formatter to develop image is affected by amount of data and speed at which formatter processes data); and c: pre-rotation step is started.

The pre-print job step is a step which comes after the pre-rotation step, and in which the abovementioned image forming process is carried out. If the printing job to be carried out is such a printing job in which multiple copies are to be continuously formed, the abovementioned image formation process is repeated to sequentially output a preset number of recording mediums P after forming an image on each recording medium P. In a continuous printing job, there is a paper interval, that is, the distance between the trailing edge of a recording medium, and the leading edge of the next medium P. Thus, while the portion of the belt 8, which corresponds to the paper interval, moves through the second transferring portion 14 and fixing apparatus F, there is no recording medium P in the second transferring portion and fixing apparatus F.

The post-rotation step is a step which is carried out after the completion of the printing job for yielding a preset number (including one) of copies, and in which the main motor is continuously driven to cause the processing devices to carry out their post-operational steps.

5) Standby step: after the completion of the post-rotation step, the main motor is stopped, and the image forming apparatus is kept on standby to wait for the inputting of the signal for starting the next printing job.

<Fixing Apparatus F>

Figure 3:
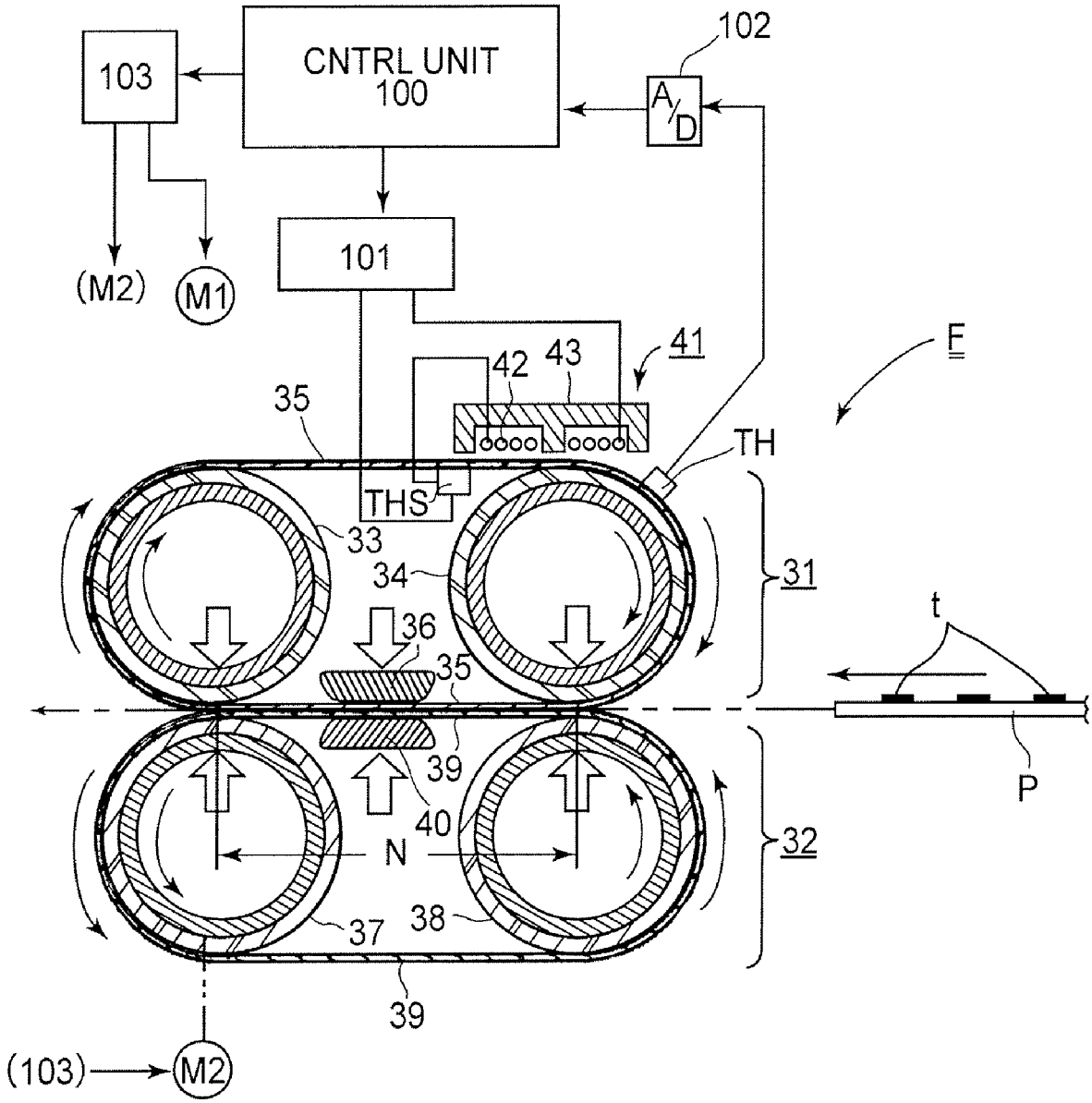
FIG. 3 is a combination of a schematic cross-sectional view of the essential portions of the fixing apparatus of the belt type in the first preferred embodiment of the present invention, and a block diagram of the control system of the fixing apparatus.

FIG. 3 is a combination of the cross-sectional view of the essential portions of the fixing apparatus F and the block diagram of the control portion of the fixing apparatus F. This fixing apparatus F is a heating apparatus (IH fixing device) which uses electromagnetic induction to heat an object.

Designated by a referential number 31 is a fixation belt unit as an image heating means, and designated by a referential number 32 is a pressure belt as a pressure applying means. The two units 31 and 32 are vertically stacked, and form a fixation nip N between them, by being caused to press upon each other by an unshown pressure application mechanism. Designated by a referential number 41 is a coil unit (magnetic flux generating means), as a heating means, for electromagnetically inducing electric current for heating. The coil unit 41 is on the top side of the fixation belt unit 31.

The fixation belt unit 31 has: a first fixation roller 33 as a belt driving roller; a second fixation roller 34 as a roller for providing a fixation belt with tension; and a fixation belt 35, which is a flexible endless belt, and is stretched around the two rollers 33 and 34. The first and second fixation rollers 33 and 34 are rotatably held by the frame (unshown) of the fixation belt unit 31, with bearings placed between each roller and frame. The first and second fixation rollers 33 and 34 are arranged roughly in parallel to each other, with the first fixation roller 33 being on the downstream side of the second fixation roller 34 in terms of the recording medium conveyance direction. The fixation belt unit 31 is also provided with a first pressure pad 36, which is on the inward side of the circular track which the fixation belt 35 forms, being next to the bottom side of the fixation belt track. The first and second fixation rollers 33 and 34, and first pressure pad 36, are components which are in contact with the fixation belt 35.

The pressure belt unit 32 has: a first pressure roller 37 as a belt driving roller; a second pressure roller 38 as a roller for providing a pressure belt with tension; and a pressure belt 39, which is a flexible endless belt, and is stretched around the two rollers 37 and 38. The first and second pressure rollers 37 and 38 are rotatably held by the frame (unshown) of the pressure belt unit 32, with bearings placed between each roller and frame. The first and second pressure rollers 37 and 38 are arranged roughly in parallel to each other, with the first pressure roller 37 being on the downstream side of the second pressure roller 38 in terms of the recording medium conveyance direction. The pressure belt unit 32 is provided with a second pressure pad 40, which is on the inward side of the circular track which the pressure belt 39 forms, being next to the top side of the pressure belt track.

Each of the fixation rollers and pressure rollers (33, 34, 37, and 38) is an elastic roller, which is made up of a hollow metallic core, and an elastic layer formed around the peripheral surface of the metallic core, of an elastic substance such as heat resistant rubber.

The fixation belt 35 is made up of an electrically conductive metallic endless belt (formed of Ni, for example) as a substrate layer, and an elastic surface layer formed on the outward surface of the metallic belt, of an elastic substance such as silicone rubber. It is a member in which heat can be generated by electromagnetic induction. Incidentally, the fixation belt 35 may be provided with a release layer as a surface layer. The pressure belt 39 is an endless belt which has an elastic layer.

As the fixation belt unit 31 and pressure belt unit 32 are pressed against each other, the first fixation roller 33 and first pressure roller 37 are pressed against each other, with the fixation belts 35 and pressure belt 39 pinched between the two rollers 33 and 37, and the second fixation roller 34 and second pressure roller 38 are pressed against each other, with the fixation belt 35 and pressure belt 39 pinched between the two rollers 34 and 38. Further, the first and second pressure pads 36 and 40 are pressed against each other, with the fixation belt 35 and pressure belt 39 pinched between the two pressure pads 36 and 40. Thus, the portion of the fixation belt 35, which is in the bottom portion of its track (path), and the portion of the pressure belt 39, which is in the top portion of its track (path), are pressed against each other, forming fixation nip N which is substantial in dimension in terms of the recording medium conveyance direction.

The first fixation roller 33 is rotationally driven by a first fixation motor M1 as a driving means in the clockwise direction indicated by an arrow mark at a preset (controlled) speed. This rotational driving of the roller 33 causes the fixation belt 35 to circularly move, and the second fixation roller 34 is rotated by the movement of the fixation belt 35.

The first pressure roller 37 is rotationally driven by a second fixation motor M2 in the counterclockwise direction indicated by another arrow mark at a preset (controlled) speed. This rotational driving of the roller 37 causes the pressure belt 39 to circularly move, and the second pressure roller 38 is rotated by the movement of the pressure belt 39.

The rotational speeds of the fixation belt 35 and pressure belt 39 are controlled so that their speeds in the fixation nip N are virtually the same. The first and second fixation motors M1 and M2, which are for rotationally driving the fixation belt 35 and pressure belt 39, respectively, are turned on and off by the control unit 100, and also, are controlled in speed by the control unit 100, through a motor driving circuit 103.

Incidentally, the first fixation roller 33 and first pressure roller 37 may be indirectly engaged with the use of connective members, such as gears and a timing belt, so that the two rollers 33 and 37 can be synchronously driven by a single motor (first fixation motor M1 or second fixation motor M2).

The induction heating coil unit 41 is the heating means for heating the fixation belt 35. It is located above the second fixation roller 34 of the fixation belt unit 31, virtually in contact with the top surface of the fixation belt 35, with the provision of a preset gap relative to the fixation belt 35.

The coil unit 41 has a coil 42 and a magnetic core 43. The magnetic core 43 is a ferrite core, a laminar core, or the like. The coil 42 is formed of copper wire coated with an electrically insulating layer and a fusion layer. It is wound a preset number of times around the core. More specifically, the coil unit 41 uses litz wire as the material wire for the coil 42. The litz wire is wound flat around a long and narrow mold to form the coil 42, which is long, narrow, and flat. Then, the thus formed coil 42 is fitted in the recess of the magnetic core 43, around the long and narrow center rib portion of the magnetic core 43. Then, the recess of the magnetic core 43, in which the coil 42 is present, is filled with electrically insulating resin, yielding the coil unit 41, which is long, narrow, and flat. The coil unit 41 is a magnetic flux generating means, which generates a magnetic flux as electric current is flowed through the coil 42.

The fixation belt 35 is heated by the heat generated in the fixation belt 35 by the electric current which is electromagnetically induced by this coil unit 41, across the portion which is moving through the heating area, that is, the area between the coil unit 41 and second fixation roller 34. That is, high frequency electric current is flowed through the coil 42 of the coil unit 41 by an excitation circuit 101, causing thereby the coil 42 to generate an alternating magnetic flux (magnetic field). This magnetic flux is absorbed by the portion of the metallic belt (substrate) of the fixation belt, which is in the abovementioned heating area, inducing thereby eddy current in the abovementioned portion of the metallic belt. As a result, heat is generated in this portion of the metallic belt by the eddy current and the specific resistivity of the metallic belt. In other words, the portion of the fixation belt, which is in the heating area, increases in temperature because it is heated by the heat generated in the metallic belt by the eddy current, which is generated by the high frequency current flowed through the coil 42.

As the fixation belt 35 and pressure belt 36 are rotationally driven, the entirety of the fixing apparatus (fixation belt 35, pressure belt 39, fixation rollers 33 and 34, pressure rollers 37 and 38, pressure pads 36 and 40, etc.) is supplied with heat. As a result, the entirety of the fixation belt increases in temperature. The surface temperature of the fixation belt 35 is detected by a temperature detecting member TH, such as a thermistor, which is placed in contact with the area of the outward surface of the fixation belt 35, which is in the heating area or the adjacencies of the heating area. The electrical information regarding the surface temperature of the fixation belt 35 detected by the temperature detecting member TH is inputted into the control unit 100 through an A/D converter 102.

Based on this information, the control unit 100 keeps the surface temperature of the fixation belt 35 at a preset level by controlling the amount by which electric power is supplied to the coil unit 41 from the excitation circuit 101. In this embodiment, the fixation temperature is set to 200° C. Thus, the temperature of the fixation belt 35 is controlled so that the surface temperature of the fixation belt 35 detected by the temperature detecting means TH remains at the fixation temperature level in this embodiment, that is, 200° C.

After the formation of a toner image t (unfixed image) on the surface of the recording medium P, the recording medium P is guided by the conveyance guide 22 into the fixing apparatus F from the image forming portion side. Then, the recording medium P enters the fixation nip N, and is conveyed through the fixation nip N while remaining pinched between the fixation belt 35 and pressure belt 39. While the recording medium P is conveyed through the fixation nip N, the unfixed toner image t on the recording medium P is welded to the surface of the recording medium P by the heat from the fixation belt 35 and pressure belt 39, and the pressure in the fixation nip N. As the recording medium P is conveyed out of the fixing apparatus F, the portion of the recording medium P, which is outside the fixing apparatus F, is separated from the fixation belt 35 and pressure belt 39. Then, the recording medium P is conveyed further to be discharged from the image forming apparatus.

Designated by a referential character THS is a thermo-switch as a safety apparatus of the fixing apparatus, which is serially placed between the excitation circuit 101 and the coil 42 of the coil unit 41. Further, the thermo-switch THS is placed in contact with the area of the inward surface of the fixation belt 35, which is in the aforementioned belt heating area or the adjacencies of the belt heating area. If the fixing apparatus becomes uncontrollable in temperature, that is, the temperature of the fixation belt 35 increases beyond a preset limit level, for some reason, the thermo-switch reacts to cut off the electric power supply to the coil unit 41 from the excitation circuit 101. In this embodiment, as the temperature of the contact area between the thermo-switch and fixation belt 35 exceeds 250° C., the thermo-switch cuts off the electric power supply to the coil unit 41 from the excitation circuit 101.

<Control of Fixing Apparatus in Standby Period>

In the warm-up period for the image forming apparatus, the control unit 100 continuously and circularly drives the fixation belt 35 and pressure belt 39 at a first speed V1, or the image formation speed. In this embodiment, the temperature of the fixing apparatus is raised to the preset level, or 200° C., by supplying the coil unit 41 with the electric power from the excitation circuit 101 while varying the amount by which the coil unit 41 is supplied with electric power, between 0-1,000 W (maximum amount).

In an image forming operation (which hereafter may be rephrased as "in a printing operation"), the control unit 100 continuously and circularly drives the fixation belt 35 and pressure belt 39 at the first speed V1, that is, the speed at which they are to be rotated during an image forming operation. Further, in this embodiment, the temperature of the fixing apparatus is maintained at the fixation level, or 200° C., by supplying the coil unit 41 with the electric power from the excitation circuit 101 while varying the amount by which the coil unit 41 is supplied with electric power, between 0-800 W (maximum amount).

Even while the image forming apparatus is kept on standby, electric power is supplied from the excitation circuit 101 to the coil unit 41. However, while the image forming apparatus is kept on standby, the fixation belt 35 and pressure belt 39 are intermittently driving. In this embodiment, while the image forming apparatus is kept on standby, the amount by which electric power is supplied to the coil unit 41 is varied between 0-500 W (maximum amount), so that the temperature of the fixing apparatus F remains roughly at the fixation level.

The reason why the amount by which the coil unit 41 is supplied, per unit length of time, with electric power is largest during the warm-up period is to increase the temperature of the fixing apparatus F from a low level to the preset level as quickly as possible. The reason why the amount by which the coil unit 41 is supplied, per unit length of time, with electric power, is low during the standby period is that during a standby period, the heat for heating the recording medium P is unnecessary, that is, heat is necessary only for maintaining the temperature of the fixing apparatus F. The amount by which electric power needs to be supplied to the coil unit 41 per unit length of time is affected by the thermal capacity of the fixing apparatus F, image formation speed, and/or the like factors.

As the cumulative length of time the fixation belt 35 and pressure belt 39 were rotationally driven increases, cracks, which are attributable to the metal fatigue, occur to the metallic belt, that is, the substrate layer of the fixation belt 35. In other words, there is a limit to the total length of time the belts 35 and 39 can be rotationally driven. Thus, rotationally driving the belts 35 and 39 during the standby period, or the period in which no image is formed, in the same manner as they are driven during a printing period, reduces the expected life span of the belts 35 and 39.

In consideration of the above described fact regarding the expected life span of the belts, it is preferable that during the standby period, the belts 35 and 39 are not rotationally driven, and the temperature of the fixing apparatus is not kept at the fixation level, that is, the coil unit 41 is not supplied with electric power. However, if the belts 35 and 39 are not rotationally driven during the standby period, and the coil unit 41 is not supplied with electric power, the temperature of the fixing apparatus F substantially falls, and therefore, it takes a substantial length of time for the temperature of the fixing apparatus F to increase to the preset level in the pre-rotation step, which is started as the next printing job start signal is inputted. Therefore, the image forming apparatus decreases in productivity, in particular, for the first copy. In other words, the length of time between when the image formation signal for the first copy is inputted and when the first copy is completed becomes longer. Further, heating the belt 35, that is, supplying the coil unit 41 with electric power, without rotationally driving the belts 35 and 39, makes the temperature of the fixation belt 35 very high only across the portion which is in the belt heating area, drastically reducing the expected life span of the fixation belt 35. As will be clear from the description of the fixing apparatus F in this embodiment, in the case of a fixing apparatus, such as the fixing apparatus F in this embodiment, in which the temperature of the fixation belt is increased by heating only the portion of the fixation belt, which is in the heating area, the belts 35 and 39 need to be always rotated when controlling the temperature of the fixing apparatus.

In this embodiment, therefore, in the standby period, electric power is supplied to the coil unit 41 from the excitation circuit 101 while intermittently rotating the fixation belt 35 and pressure belt 39, as described above, in order to prevent the temperature control of the fixing apparatus from reducing the belts 35 and 39 in the expected life span. Hereafter, this method of maintaining the temperature of the fixation belt at a preset level during the standby period, without reducing the fixation belt in expected life span, will be described in detail.

Figure 4:
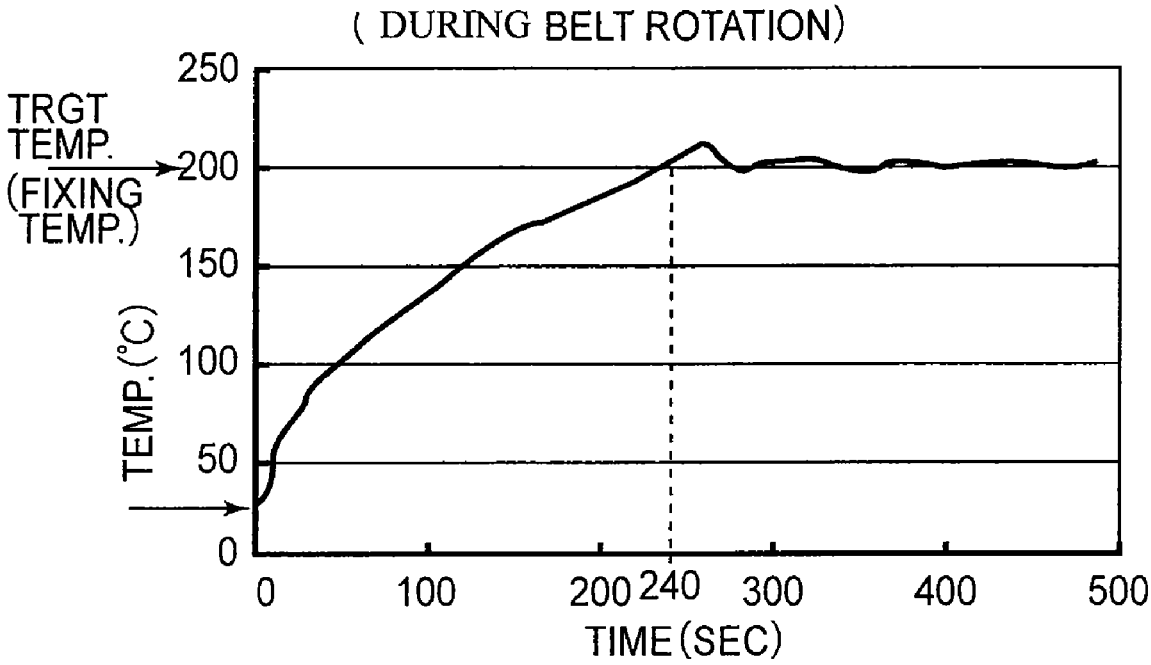
FIG. 4 is a graph showing the changes in the temperature of the fixation belt, which occurred when the belt was controlled in temperature while rotating the belt.

FIG. 4 shows the changes in the surface temperature of the fixation belt 35, which occurred while the fixing apparatus F was controlled so that the surface temperature of the fixation belt 35 detected by the temperature detecting member TH was maintained at 200° C. As the fixation belt 35, the surface temperature of which was equal to the room temperature, was heated, the surface temperature of the fixation belt 35 reached the target temperature of 200° C. in roughly 240 seconds. Thereafter, it remained roughly at the target temperature of 200° C. The fixation belt 35 itself is small in thermal capacity. Further, the heat generated in the fixation belt 35 is robbed by the pressure belt 39, fixation rollers 33 and 34, pressure rollers 37 and 38, pressure pads 36 and 40, etc., from the fixation roller 35 while the fixation belt is rotationally driven. Therefore, the length of time it takes for the temperature of the fixation roller 35 to actually increase to the preset level is much longer than that it would have taken for the surface temperature of the fixation roller 35 to increase to the preset level if the fixation roller 35 were not in contact with the other components.

Figure 5:
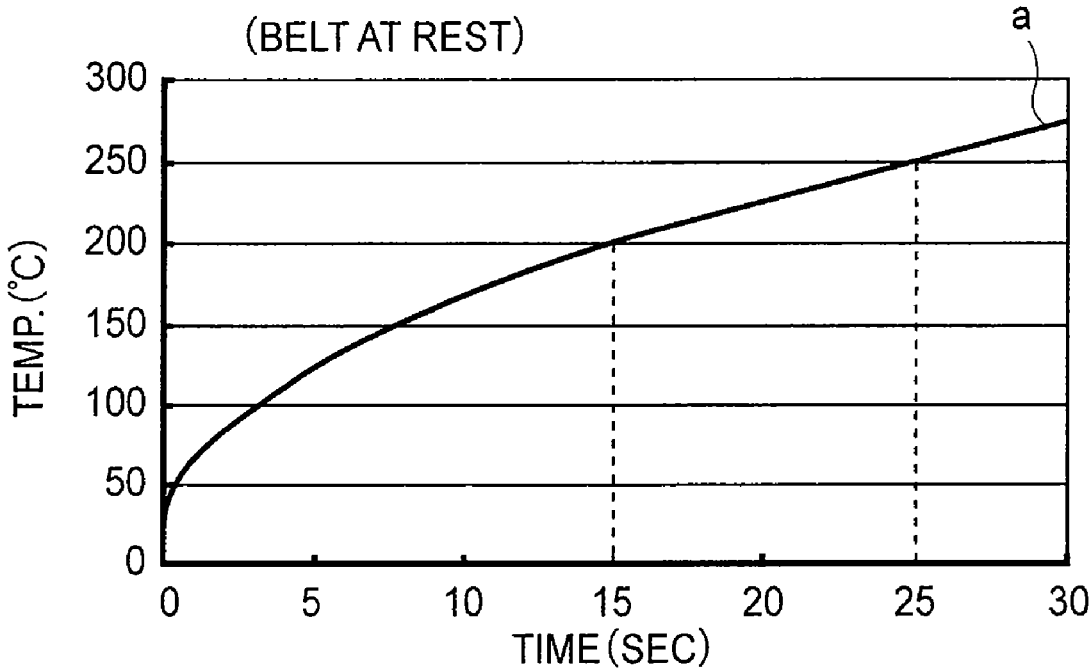
FIG. 5 is a graph showing the changes in temperature, which occurred to the area of the fixation belt, which was heated while keeping the belt stationary.

FIG. 5 shows the changes in the surface temperature, which occurred to the portion of the fixation belt 35, which was in the belt heating area, when electric power was supplied to the coil unit 41 from the excitation circuit 101 to heat the fixation belt, with the belts 35 and 39 being kept stationary.

If the fixation belt 35 is heated when the fixation belt 35 is stationary, the temperature of the fixation belt 35 abnormally increases only across the portion which is in the belt heating area. When the fixation belt 35 was heated while it was rotated, it took 240 seconds for the temperature of the entirety of the fixation belt 35 to reach 200° C., as shown in FIG. 4. However, when the fixation belt 35 was heated while it was stationary, the temperature of the portion of the fixation belt 35 which is in the belt heating area reached 200° C. in roughly 15 seconds. In this embodiment, as the temperature of the thermo-switch THS, which is in contact with the fixation belt 35, reaches 250° C., the thermo-switch THS cuts off the power supply to the coil unit 41, as described above. Therefore, if the fixation belt 35 is heated no less than 25 seconds while it is kept stationary, the temperature of the above described portion of the fixation roller 35 reaches 250° C., at which the thermo-switch reacts, as is evident from FIG. 5.

Referring to FIG. 5, once the temperature of the fixation belt 35 reached 150° C., it increased roughly at the same rate, which was roughly 5.6 degrees per second, as indicated by the single-dot chain line a in FIG. 5. When the fixation belt 35, the temperature of which was maintained at 200° C., was continuously heated after the rotation of the fixation belt 35 was stopped, the surface temperature of the portion of the fixation belt 35, which was in the belt heating area, reached 250° C. in 8.9 seconds.

Figure 6:
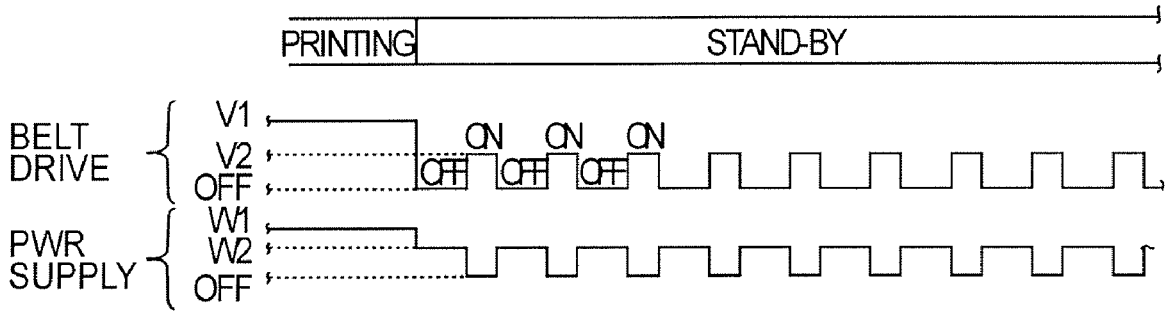
FIG. 6 is a diagram showing the operational timing of the image forming apparatus, the operational speeds of the belt, and the amounts by which power is supplied, in the first preferred embodiment.

FIG. 6 is a timing chart showing the periods in which the belts 35 and 39 are rotationally driven, or kept stationary, in the standby period. During an image forming operation, the belts 35 and 39 are rotationally driven at the first speed V1, that is, the speed at which the belts 35 and 39 are to be rotationally driven for image formation. As a standby period arrives, the rotation of the belts 35 and 39 is temporarily stopped, while the portion of the fixation belt 35, which is in the belt heating area, remains heated. Thereafter, the belts 35 and 39 are driven at the second speed V2, which is slower than the first speed V1. Stopping this rotation of the belts 35 and 39 after the belts 35 and 39 are rotated several full turns is more likely to make the entirety of the fixing apparatus F uniform in temperature. The reason for driving at the second speed V2 is that not only is the slower speed is better for making the entirety of the fixing apparatus F uniform in temperature, but also, it reduces the distance by which the belt must be rotated to make the entirety of the fixing apparatus F uniform in temperature. Thereafter, this process of rotating and stopping the belts is repeated.

The maximum amount by which electric power is supplied to the coil unit 41 per unit length of time in an image forming period is set to a first maximum power of W1 (which in this embodiment is 800 W) . The maximum amount by which electric power is supplied to the coil unit 41 per unit length of time while the belts 35 and 39 are kept stationary in a standby period is set to a second maximum power of W2 (which in this embodiment is 500 W), which is smaller than the first maximum power W1. In this embodiment, the apparatus is controlled so that while the belts are rotationally driven in a standby period, the coil unit 41 is not supplied with electric power. However, the apparatus may be set up so that even while the belts are rotationally driven in a standby period, the coil unit 41 is provided with electric power by no more than the second maximum amount to control the temperature of the fixing apparatus.

The overall distance by the belts 35 and 39 must be rotationally driven to make the fixing apparatus F uniform in temperature can be reduced by intermittently driving the belts 35 and 39 at a slower speed in a standby period. Further, the belts 35 and 39 are rotationally driven so that when the fixation belt 35 is stopped next time, the portion of the fixation belt, which is in the belt heating area while the belt is kept stationary, will be in contact with one of the aforementioned components of the fixating apparatus, which are in contact with the fixation belt 35, and which are greater in thermal capacity. Hereafter, these components will be referred to as "belt contacting members". With the employment of this arrangement, the nonuniformity in the temperature of the belts, which occurs while the belts are kept stationary, can be substantially reduced. It is unnecessary that the portion of the fixation belt, which is heated by remaining facing the coil unit 41 in a standby period, is placed in entirety in contact with one of the "belt contacting members". That is, only requirement is that at least a part of the heated portion of the fixation belt is placed in contact with one of the "belt contacting members".

Next, this control will be described. In this embodiment, the portion of the belt, which is heated by the heating means, is the portion of the belt, which is facing the coil unit 43. In the case of a fixing apparatus in which the fixation belt is placed in contact with the heating member, the portion of the belt, which is heated by the heating means, is the portion of the belt, which is in contact with the heating member. Further, in this embodiment, the positions which are larger in thermal capacity are synonymous with the components of the fixing apparatus, which are in contact with the belts. More specifically, they means the first fixation roller 33, second fixation roller 34, and first pressure pad 36.

Therefore, in this embodiment, the fixing apparatus is controlled so that the portion of the fixation belt, which is facing the heating means while the belt is kept stationary, will stop so that it will be in contact with one of the first fixation roller 33, second fixation roller 34, and first pressure pad 36 when the belt is stopped next time. By controlling the fixing apparatus as described above, the fixing apparatus can be improved in terms of the thermal conduction from the portion of the fixation belt, which was being heated, to the "belt contacting members", and therefore, it is possible to aggressively warm the "belt contacting members" which rob a large amount of heat from the fixation belt.

Also in this embodiment, the fixing apparatus is provided with three "belt contacting members". Therefore, it is unnecessary that the heated portion of the fixation belt is to be always stopped in the same area in which the heated portion contacts the same "belt contacting member". In other words, there is no problem even if the fixing apparatus is structured so that the "belt contacting member" which the heated portion of the fixation belt contacts when the belt is stopped first time in a standby period may be different from that when the belt is stopped next time in the standby period.

One example of such an arrangement is to switch the "belt contacting components" with which the heated portion of the fixation belt is placed in contact. For example, the rotation of the fixation belt may be controlled so that when the fixation belt is stopped for the first time in a standby period, the heated portion of the fixation belt is placed in contact with the first fixation roller 33, and when the fixation belt is stopped for the second time in the standby period, the heated portion is placed in contact with the second fixation roller 34, and so on. With the employment of this control method, the belt contacting members are equally warmed up.

On the other hand, it is preferable that a fixing apparatus is structured so that the upstream belt contacting member, in terms of the recording medium conveyance direction, is greater in thermal capacity than the downstream belt contacting member. Thus, it is desired that the frequency with which the heated portion of the fixation belt is placed in contact with is weighted. In this embodiment, the belt contacting members are arranged in the order of the second fixation roller 34, first pressure pad 36, and first fixation roller 33, listing from the upstream side in terms of the recording medium conveyance direction. Therefore, the order of the belt contacting members, in terms of the amount by which the fixation belt is robbed of heat, is the same as the order in which they are arranged. The frequencies with which the heated portion of the fixation belt is placed in contact with them are weighted according to the order in which they are positioned in terms of the recording medium conveyance direction. That is, the ratio of the frequency with which the heat portion of the fixation belt is stopped at the second fixation roller 34, first pressure pad 36 and first fixation roller 33, is set to 3:2:1. This ratio of frequency is only an example of the weighted frequency; the weighted ratio may be different from the one used in this embodiment.

Not only does the employment of the above described structural warm the belt contacting members in a preferable manner, but also, it prevents heat from concentrating in a specific portion of the fixation belt, in a standby period.

The length of time the belts 35 and 39 need to be kept stationary is no more than 8.9 seconds; it is set to three seconds, for example. With the length of time the belts 35 and 39 is kept stationary set to 3 seconds, the temperature of the fixation belt 35 increases to roughly 217 degrees (in 3 seconds) after the stopping of the fixation belt, the temperature of which was being maintained at 200° C. Therefore, the thermo-switch is not going to react.

The length of time the belts 35 and 39 are to be rotated each time the belts 35 and 39 need to be rotated in a standby period has only to be set to be long enough for the heat distribution of the fixation belt changes from the state in which only the portion of the fixation belt, which is in the belt heating area, is substantially high in temperature than the rest, to the state in which the entirety of the fixing apparatus is uniform in temperature. It is set to 3 seconds, for example. It is affected by the thermal capacity of a fixing apparatus, and/or the target temperature level for temperature control; it should be adjusted according to these factors.

On the other hand, even when the image forming apparatus (fixing apparatus) is on standby, electric power is supplied to the coil unit 41 from the excitation circuit 101 while intermittently rotating the belts 35 and 39. Therefore, it does not occur that certain portions of the fixing apparatus are abnormally increased in temperature. Therefore, the temperature of the fixing apparatus can be maintained at a preset level so that the entirety of the fixing apparatus is maintained at the preset level, without reducing the expected life span of the belts 35 and 39.

Figure 7:
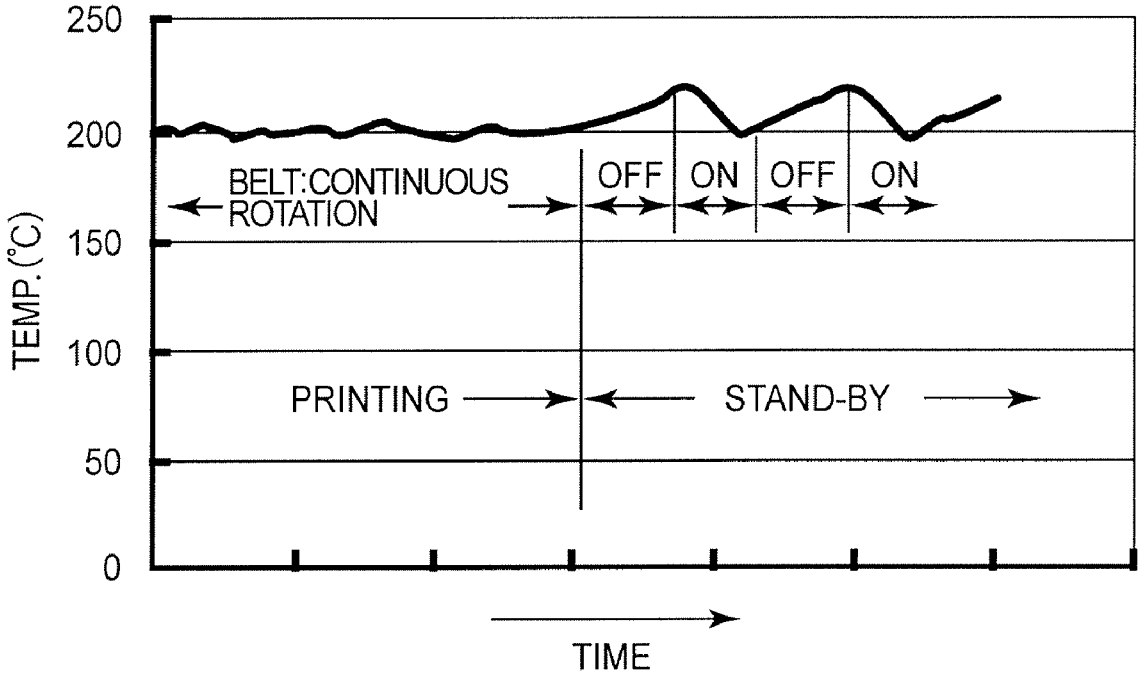
FIG. 7 is a graph showing the changes in the fixation belt temperature, which occurred while images were printed, and those which occurred while the image forming apparatus was on standby.

FIG. 7 shows the changes in the temperature of the fixation belt 35, which occurred while the fixing apparatus was kept on standby. During a printing period, the fixation belt 35 is continuously rotated while being controlled in temperature so that its temperature remains at 200° C. As a standby period begins, the fixation belt 35 is stopped and kept stationary for a while, and then, restarted. This process of keeping the fixation belt stationary for a while and then, restarting it, is repeated in a standby period. The portion of the fixation belt 35, which is in the belt heating area while the fixation belt is kept stationary, increases in temperature. However, the rotation of the fixation belt 35 is started before the temperature of this portion of the fixation belt reaches the temperature level at which the thermo-switch reacts. Therefore, the heat which this portion of the fixation belt has is robbed by the fixation roller 34 or the like. Therefore, the temperature of this portion of the fixation belt 35 decreases. Thereafter, the above described processes are repeated. Therefore, while the fixing apparatus is kept on standby, the temperature of the fixation belt 35 fluctuated as shown in FIG. 7.

As described above, not only can this embodiment prevent heat from concentrating in a small area of the fixation belt while keeping the belt stationary in a standby period, but also, it can warm the belt contacting portions of the fixing apparatus in an ideal manner.

Embodiment 2

In the first embodiment described above, the length of the interval with which the belts 35 and 39 were rotationally driven in a standby period was set so that the thermo-switch as a safety apparatus did not react.

In this second preferred embodiment, the length of time the motors M1 and M2 for rotationally driving the belts 35 and 36 are kept stationary, that is, the length of time the belts 35 and 39 are kept stationary, is controlled according to the detected temperature of the fixation belt 35.

Figure 8:
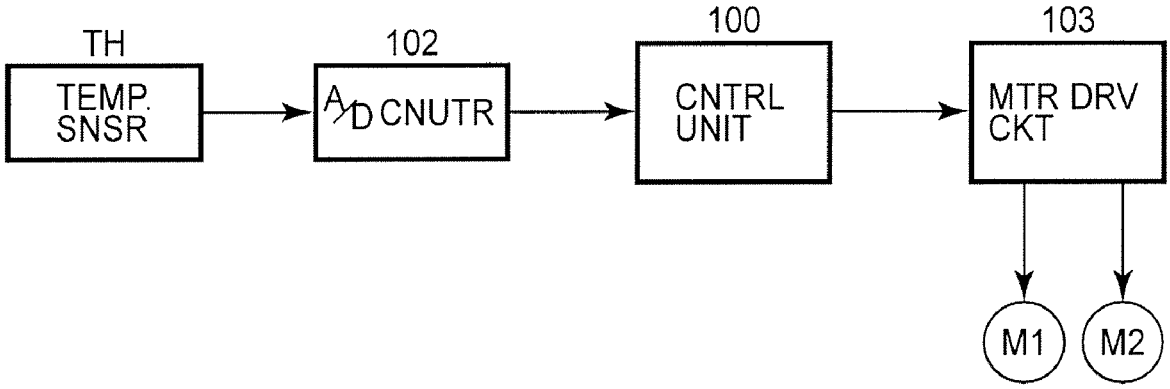
FIG. 8 is a block diagram of the fixation motor control system in the second preferred embodiment of the present invention.

FIG. 8 is a block diagram of the motor controlling system in this embodiment. The temperature detecting means TH for detecting the temperature of the fixation belt 35 outputs voltage, the amplitude of which is proportional to the detected temperature of the fixation belt 35. This voltage is inputted into the A/D convertor 102. The A/D converter 102 converts this inputted voltage which indicates the detected temperature of the fixation belt 35 into a digital signal, and transfers the digital signal to the control unit 100. The control unit 100 controls the motor driving circuit 103, which is for driving the motors M1 and M2, according to the inputted information regarding the detected temperature of the fixation belt 35.

Figure 9:
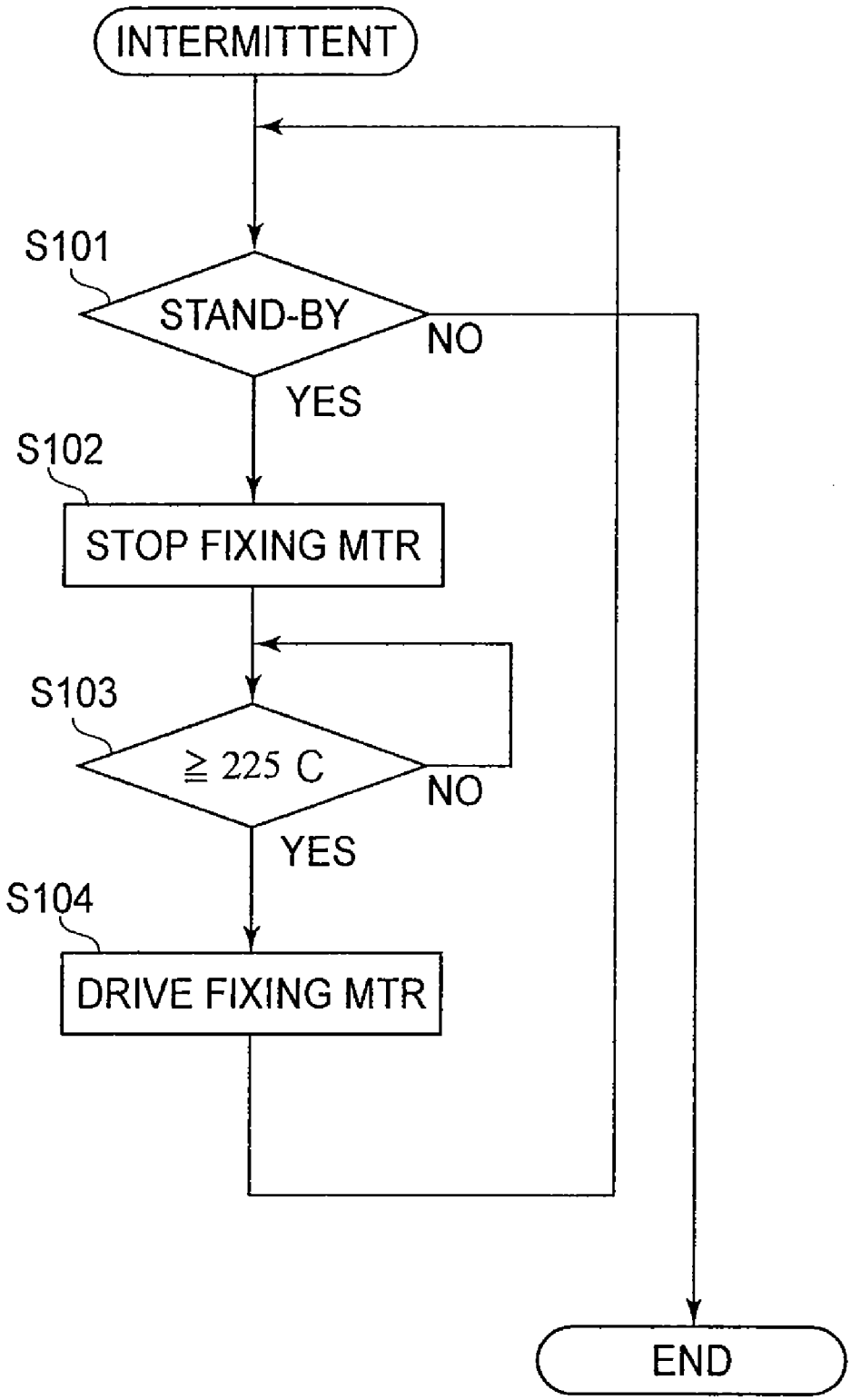
FIG. 9 is a flowchart of the operation for driving the fixation motor, in the second preferred embodiment.

The control unit 100 controls the motor driving circuit 103 according to the flowchart in FIG. 9. That is, in Step S101, it is checked whether or not the image forming apparatus is on standby. If it is determined that the image forming apparatus is on standby, the fixation motors M1 and M2 are stopped in Step S102. Next, the temperature of the fixation belt 35 is detected in Step S103. If it is no less than 225° C., the fixation motors M1 and M2 are driven in Step S104. If it is not, the fixation motors M1 and M2 are kept stationary until it becomes no less than 225° C. In Step S104, the fixation motors M1 and M2 are driven for 3 seconds, for example, as they were in the first embodiment. Thereafter, the control sequence returns to Step S101. Then, if it is determined that the image forming apparatus is on standby, the above described portion of the flowchart is repeated. If not, for example, if it is determined that the image forming apparatus is in the image formation mode, this control sequence is ended.

The manner in which electric power is supplied to the coil unit 41, as the fixation belt heating means, in this embodiment is the same as that shown in FIG. 6. That is, it is while the fixation belt 35 is kept stationary that electric power is supplied to the coil unit 41, and the amount, by which electric power is supplied to the coil unit 41 while the fixation belt 35 is kept stationary, is the second maximum amount W2.

As described above, also in this embodiment, the overall distance by which the belts 35 and 39 are driven is reduced by intermittently driving the belts 35 and 36 in a standby period as it was in the first embodiment. Therefore, it is possible to provide a fixing apparatus of the belt type, which is capable of keeping the temperature of the fixation belt at a preset level even during a standby period, without reducing the expected life span of the fixation belts.

Embodiment 3

In the second preferred embodiment described above, the length of time the motors M1 and M2 for rotationally driving the belts 35 and 39 are kept stationary in a standby period was controlled according to the temperature of the fixation belt 35.

In this embodiment, the length of time the motors M1 and M2 are driven each time in a standby period is also controlled according to the temperature of the fixation belt 35.

Figure 10:
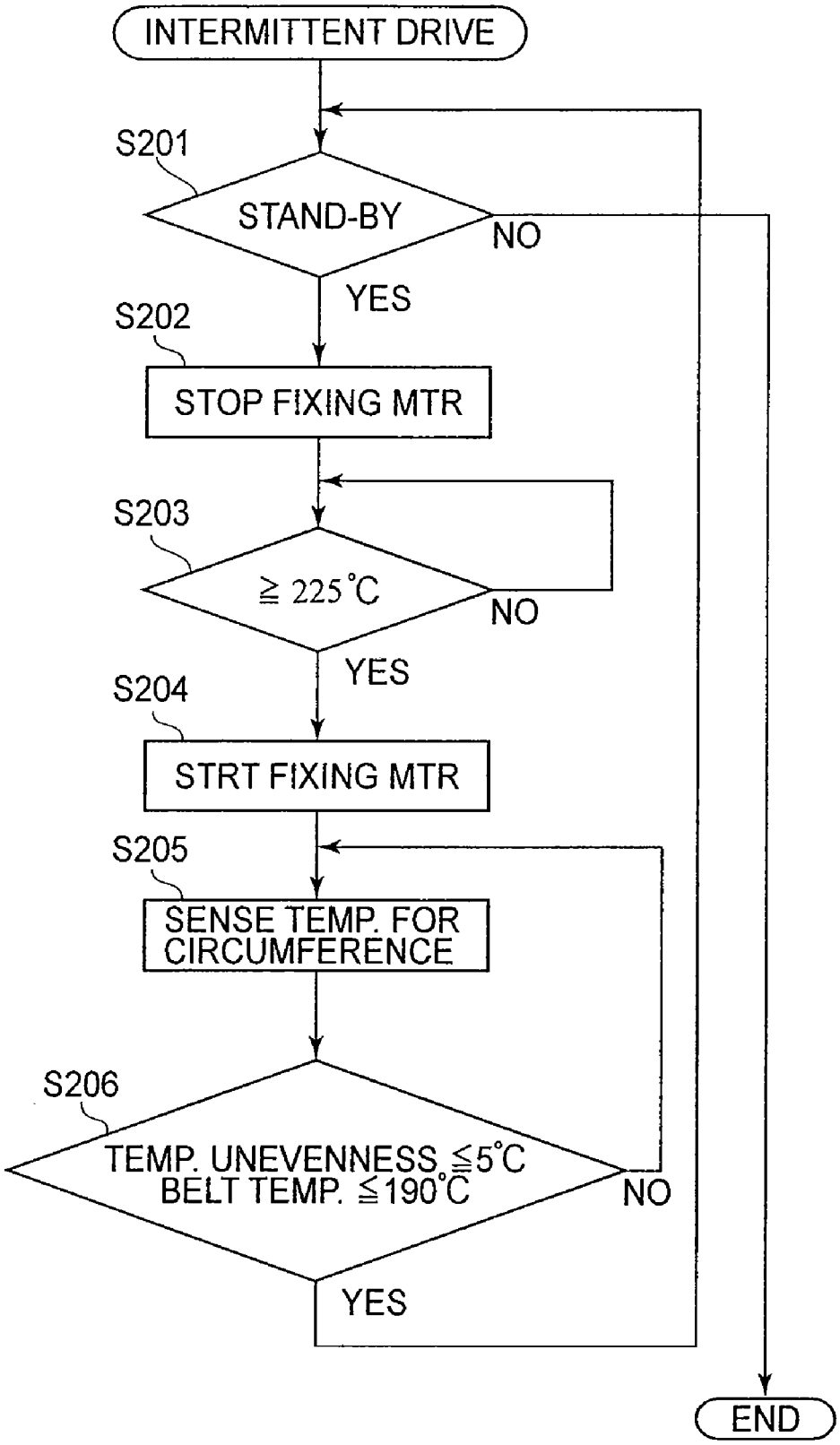
FIG. 10 is a flowchart of the operation for driving the fixation motor, in the third preferred embodiment.

The control unit 100 controls the motor driving circuit 103 according to the flowchart in FIG. 10. That is, in Step S201, it is checked whether or not the image forming apparatus is on standby. If it is determined that the image forming apparatus is on standby, the fixation motors M1 and M2 are stopped in Step S202. Next, the temperature of the fixation belt 35 is detected in Step S203. If it is no less than 225° C., the fixation motors M1 and M2 are driven in Step S204. If it is not, the fixation motors M1 and M2 are kept stationary until it becomes no less than 225° C. In Step S204, the fixation motors M1 and M2 are driven while controlling the temperature of the fixation belt 35. In Step S205, the temperature of the fixation belt 35 is measured at several points on the fixation belt 35 in terms of the circumferential direction. In Step S206, if the difference between the highest and lowest among the detected temperatures of the several points of the fixation belt 35 is no more than 5° C., and the entirety of the fixation belt temperature has not fallen to 190° C., which is 10° C. lower than the target temperature level of 200° C. at which the belt temperature is to be maintained during a printing period, the control sequence is returned to S205, in which the belt temperature is measured while the driving of the fixation motors M1 and M2 is continued. If not, the control sequence is returned to Step S 201, in which it is checked again if the image forming apparatus is on standby. If it is determined that the image forming apparatus is on standby, the preceding portion of the control sequence is repeated. If it is determined that the image forming apparatus is not on standby, for example, the image forming apparatus is in an image forming operation, this control sequence is ended.

Also in this embodiment, it is while the belt is kept stationary when electric power is supplied to the coil unit 41 as the fixation belt heating means, and it is by the second maximum mount W2 that electric power is supplied to the coil unit 41, as shown in FIG. 6.

The reason why the target temperature level at which the temperature of the fixation belt 35 is to be maintained during standby period is set to the level which is 10° C. lower than the target temperature level of 200° C. at which the temperature of the fixation belt 35 is to be maintained during a printing period is that when the temperature of the fixation roller 35 is kept at this level, it will recover to 200° C., or the target temperature level for a printing period, by the time the recording medium P arrives at the fixing apparatus F after the image forming apparatus is switched in mode from the standby mode to the printing mode. Thus, in the case of an image forming apparatus, in which it takes a long time for recording medium to reach the fixing apparatus, or the temperature of the fixing apparatus F rises fast, the target temperature level for a standby period may be lowered.

Thus, the fixation motors M1 and M2 are kept stationary until the fixation belt temperature reaches 225° C. Then, they are driven until the difference between the highest and lowest among the detected temperatures of the several points of the fixation belt 35 in terms of the circumferential direction of the fixation belt becomes no more than 5° C., and the temperature of the fixation belt, which is detected by the temperature detecting means TH, falls to 190° C.

Incidentally, in Step S204, while the fixation motors are driven, the fixation belt 35 may be heated by the coil unit 41, or may be left unheated.

As described above, also in this embodiment, the overall distance by which the belts 35 and 39 are driven is reduced by only intermittently driving the belts 35 and 36 in a standby period as it was in the first embodiment. Therefore, it is possible to provide a fixing apparatus of the belt type, which is capable of keeping the temperature of the fixation belt at a preset level even during a standby period, without reducing the expected life span of the fixation belts.

Figure 11:
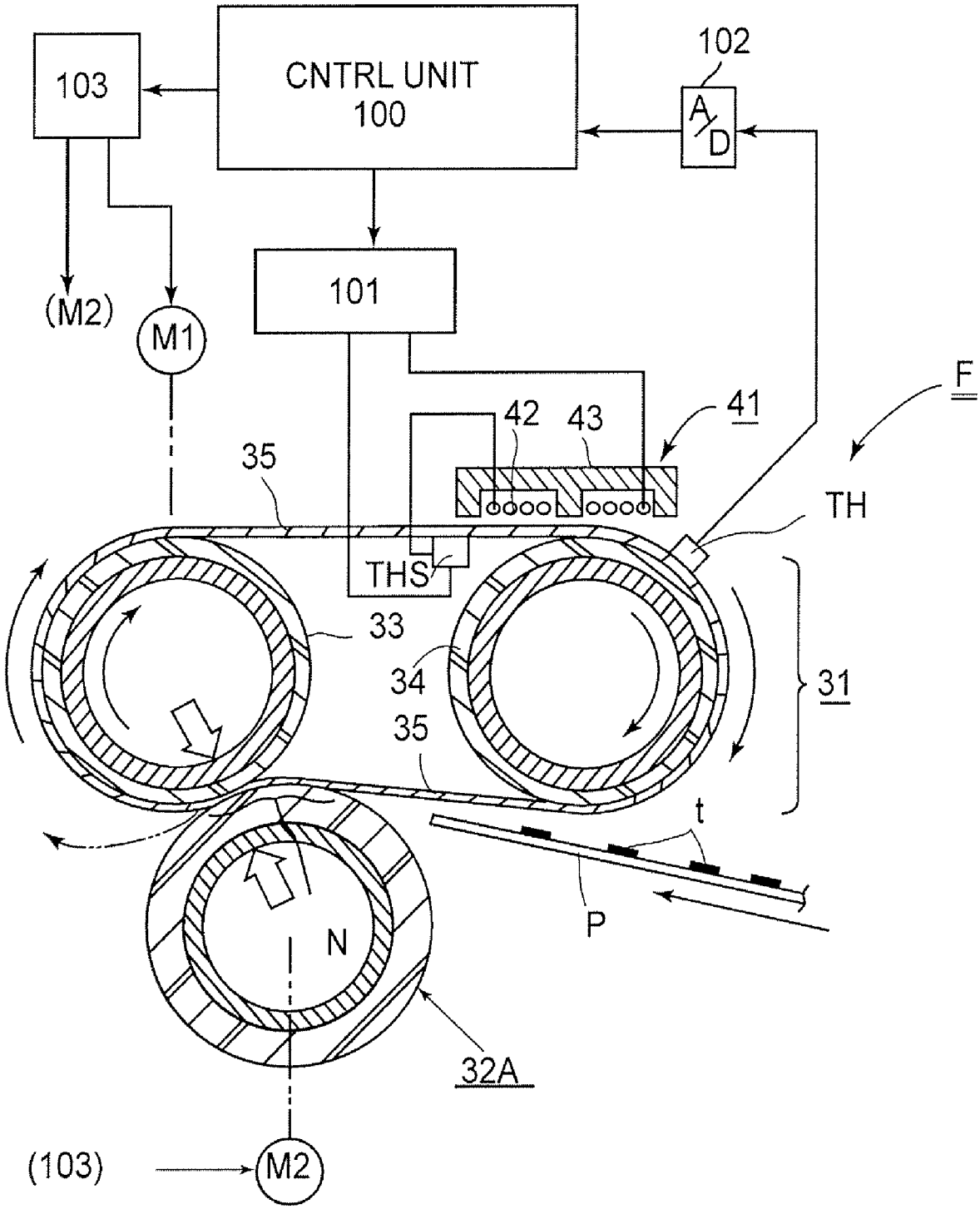
FIG. 11 is a combination of a schematic sectional view of a fixing apparatus of the belt type, which is different in structure from the preceding fixing apparatuses of the belt type, and the block diagram of the control portion therefor.

Obviously, the structure for a fixing apparatus to which the present invention is applicable is not limited to those in the above described preferred embodiments, one of which is shown in FIG. 3. For example, the present invention is also applicable to the fixing apparatus structured as shown in FIG. 11, in which the pressure applying member is a pressure roller 32A. In this case, the fixing apparatus is desired to be structured so that the frequency with which the portion of the fixation belt, which is facing the heating means while the fixation belt is kept stationary, is stopped in contact with a first belt suspending member 33 is higher than the frequency with which the portion of the fixation belt, which is facing the heating means while fixation belt is kept stationary, is stopped in contact with a second belt suspending member 34. Regarding the means for heating the fixation belt 35, a unit which irradiates infrared light or high frequency waves, a heater unit which is placed in contact with the inward or outward surface of the fixation belt 35, or a heater unit which can be placed in contact with, or separated from, the fixation belt 35, may be employed instead of the coil unit 41 for induction heating. Further, a heater may be placed in the second fixation roller 34 and/or first fixation roller 35 to use the second fixation roller 34 and/or first fixation roller 35 as the means for heating the fixation belt 35.

As will be evident from the above given descriptions of the preferred embodiments of the present invention, according to the present invention, it is possible to substantially extend the expected life span of a fixation belt, without reducing an image forming apparatus in productivity, that is, without increasing the length of time it takes for the image forming apparatus to yield the first copy after being kept on standby.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 098917/2006 filed Mar. 31, 2006 which is hereby incorporated by reference.

What is claimed is:

1. An image heating apparatus comprising:

an endless belt for heating an image on a recording material;

heating means for heating a part of said endless belt;

driving means for rotating said endless belt;

a contact member for contacting an inner surface of said endless belt;

stand-by control means operable in a stop period in which said heating means effects heating with said endless belt at rest and in a rotation period in which said endless belt is rotated; and drive stop control means for stopping, upon stoppage of rotation of said endless belt in the rotation period, said endless belt at a position that the contact member contacts at least a part of a portion of said endless belt that has been opposed to said heating means in a previous stop period.

2. An apparatus according to claim 1, wherein a plurality of contact members are provided, and one of said plurality of contact members that overlapps with the portion of said endless belt is selected.

3. An apparatus according to claim 1, wherein said contact member is a first contact member, and further comprising:

a pressing member for cooperating with an outer periphery of said endless belt to form a nip; and a second contact member for pressing said pressing member through said endless belt, wherein in a stand-by period, a frequency of contact between said second contact member and the portion of said endless belt is larger than a frequency of contact between said first contact member and the portion of said endless belt.

4. An apparatus according to claim 1, wherein in the rotation period, said heating means heats said endless belt that is rotating.

5. An apparatus according to claim 1, wherein said contact member stretches said endless belt therearound.

6. An apparatus according to claim 1, wherein a maximum electric power value supplied to said heating means in a stand-by period is smaller than a maximum electric power value supplied to said heating means during an image forming operation.

7. An apparatus according to claim 1, wherein a rotational speed of said endless belt in the rotation period is lower than a rotational speed of said endless belt during an image forming operation.

8. An apparatus according to claim 1, further comprising a temperature detecting member for detecting temperatures of said endless belt, wherein said endless belt starts its rotation in a stand-by period on the basis of an output of said temperature detecting member.

9. An apparatus according to claim 1, wherein said endless belt includes an electroconductive layer, and said heating means includes magnetic flux generating means for generating a magnetic flux.

* * * * *